US005555804A

United States Patent [19]

Kojima

[11] Patent Number: 5,555,804

[45] Date of Patent: Sep. 17, 1996

[54] PERFECTING SHEET ROTARY OFFSET PRESS

[75] Inventor: Yasutaka Kojima, Tokyo, Japan

[73] Assignee: Akiyama Printing Machine Manufacturing Company Ltd., Tokyo, Japan

[21] Appl. No.: 263,141

[22] Filed: Jun. 21, 1994

[30] Foreign Application Priority Data

Jun. 25, 1993 [JP] Japan ..... 5-155124

[51] Int. Cl.[6] ..... B41F 7/06

[52] U.S. Cl. ..... 101/183; 101/231

[58] Field of Search ..... 101/229, 230, 101/231, 177, 183, 137, 136

[56] References Cited

U.S. PATENT DOCUMENTS 1,282,642 10/1918 Scott ..... 101/231

2,898,851 8/1959 Peyrebrune ..... 101/231

4,493,255 1/1985 Fischer ..... 101/183

5,110,095 12/1893 Scott ..... 101/231

*Primary Examiner*—J. Reed Fisher

*Attorney, Agent, or Firm*—Bauer & Schaffer

[57] ABSTRACT

A perfecting sheet rotary offset press has a top surface printing unit and a back surface printing unit each formed of an impression cylinder, and a blanket cylinder, a plate cylinder, and an inking mechanism which are disposed above or below the impression cylinder, respectively. The top and back surface printing units are connected through the impression cylinders constituting the respective printing units. A sheet is sequentially transferred by the respective impression cylinders of the top and back surface printing units, and printing is performed on the top and back surfaces of the sheet as it passes through the printing units. Thus, this perfecting sheet rotary offset press can print at high speeds and presents few printing faults, and its dimension can be made smaller.

5 Claims, 15 Drawing Sheets

PERFECTING SHEET ROTARY OFFSET PRESS

BACKGROUND OF THE INVENTION

1. Field of the Invention

The present invention relates to perfecting sheet rotary offset presses or printing machines, and more particularly to machines capable of performing offset printing on both the top and back surfaces of a sheet respectively in one color or in a plurality of colors through a single sheet feeding operation.

2. Description of the Related Art

Conventionally, among sheet rotary offset presses, there are known a so-called reversal perfecting press, a blanket-to-blanket perfecting web offset press, as well as other types of presses.

An example of the reversal perfecting press is disclosed in Japanese Patent Publication No. 1-56672 which comprises a back surface printing section, a top surface printing section, a sheet reversing section, and so on. After the back surface of a sheet has been printed in a plurality of color by the back surface printing section, the sheet is reversed by the sheet reversing section to transfer the sheet to the top surface printing section which then provides multi-color printing on the top surface of the sheet.

The blanket-to-blanket perfecting web offset press is disclosed in Laid-open Japanese Patent Application No. Here a plurality of blanket cylinders and impression cylinders, each provided with a rubber blanket adhered thereon, are alternately arranged in the horizontal. A top portion of each blanket cylinder and a bottom portion of each impression cylinder are respectively provided with a plate cylinder, an ink feeding mechanism, a dampening arrangement, and so on to constitute a printing unit. Further, each of the blanket cylinders and impression cylinders is provided with a gripper such that multi-color printing is performed on both surfaces of a sheet while the sheet is being transferred.

An example of other types of presses is disclosed in Japanese Patent Publication No. 3-21346. In this press, two pairs of laterally arranged plate cylinders and rubber cylinders are combined with a common impression cylinder, which has a diameter three times larger than that of the cylinders of the plate cylinders and rubber cylinders, and is provided with a sheet gripper, so as to constitute a five-cylinder-two-color printing unit. Then, two sets of printing units are alternately arranged in the vertical direction such that the positional relationship of the plate cylinders and the rubber cylinders with respect to the impression cylinder is defined in an alternate manner in the horizontal direction. The respective impression cylinders are coupled such that a line connecting the axes of the impression cylinder presents a zig-zag line. A sheet feeder unit is coupled to an impression cylinder located at the lowermost position, while a take-off unit is coupled to an impression cylinder at the topmost impression cylinder, so as to achieve four-color printing on both top and back surfaces of sheets in two-color unit.

However, the reversal perfecting press has a drawback in that due to the fact that it employs a gripper for gripping the trailing edge portion of a sheet tranferred by the sheet reversing section its mechanism behaves rather violently, the printing speed is lower than a one-surface press, and the registering accuracy for printing is easily degraded. In addition to this, when the size of the sheet is to be changed, a great deal of time is required to alter the gripper position on the trailing edge of the sheet. The size of sheets processed by the prior art press is limited to a certain range. Furthermore, since the prior art press requires two sheet feeding cylinders and two reversal cylinders for the reversing mechanism, the length of the whole machine is extremely large.

The blanket-to-blanket perfecting web offset press in turn simultaneously prints on both surfaces of a sheet, so that, a printed sheet may possibly touch the blanket cylinder, on which ink is attached, to cause a stained sheet. Also, doubled printing may occur due to the structural defects. More specifically, a possible error in the thickness of blankets may result in a delicate difference in the cylinder arrangement dimension of the two blanket cylinders, which may in turn lead to doubled printing. This type of perfecting press therefore requires countermeasures to avoid such defective printing. Further, since the blanket-to-blanket perfecting web offset press does not have an impression cylinder which serves as a reference plane for applying a printing impression, printed sheets produced thereby is disadvantageously lacking in sharpness.

The perfecting press described in the above-mentioned Japanese Patent Publication No. 3-21346 is suitable only for printing on sheets of small sizes. It is not therefore practical to modify this perfecting press so as to print on sheets of relatively large sizes, in consideration of the size of printing plants, because of the height of the press which would be unacceptably increased if modified for sheets of larger sizes.

OBJECTS AND SUMMARY OF THE INVENTION

The present invention has been made in view of the problems inherent to the prior art perfecting presses described above, and it is an object of the present invention to provide a new perfecting sheet rotary offset press which is capable of simultaneously solving a variety of inconveniences as described above.

To achieve the above object, the present invention provides a perfecting sheet rotary offset press which comprises: a top surface printing unit including an impression cylinder having a sheet gripper, a blanket cylinder, a plate cylinder, and an inking mechanism, wherein the blanket cylinder, the plate cylinder and the inking mechanism is disposed above the impression cylinder. A back surface printing unit is provided, including an impression cylinder having a sheet gripper, a blanket cylinder, a plate cylinder, and an inking mechanism wherein, the blanket cylinder, the plate cylinder and the inking mechanism wherein are disposed below the impression cylinder. The top surface printing unit and the back surface printing unit are connected through the impression cylinders constituting the respective printing units.

The above and other objects, features and advantages of the present invention will become more apparent from the following description when read in conjunction with the accompanying drawings in which preferred embodiments of the present invention are shown by way of illustrative examples.

DETAILED DESCRIPTION OF THE PREFERRED EMBODIMENTS

The present invention will hereinafter be described in connection with preferred embodiments thereof with reference to the accompanying drawings.

Figure 1:
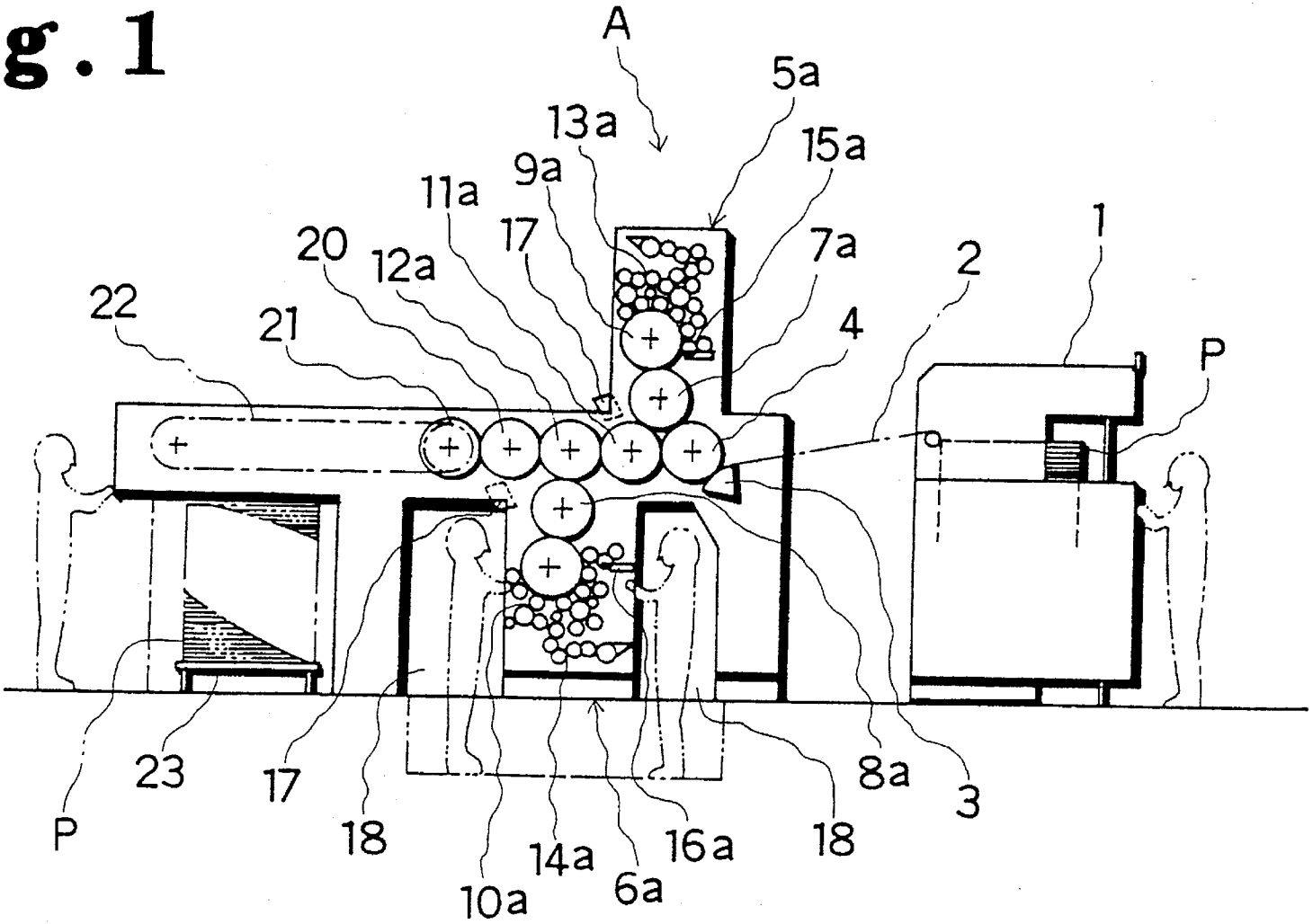
FIG. 1 is a schematic lateral view showing an embodiment of a perfecting multi-color sheet rotary offset press to which the present invention is applied.

As seen in FIG. 1 sheets P piled in a feeder body 1 are fed one by one through a feeder board 2, a swinger 3 and a transfer cylinder 4 to a printing section A, in which printing is performed on both the top and back surfaces of the sheet P.

The printing section A is composed of a top surface printing unit 5*a* and a back surface printing unit 6*a*.

The top surface printing unit 5*a* includes a blanket cylinder 7*a*, a plate cylinder 9*a*, a sheet gripper (not shown), an impression cylinder 11*a* having the same diameter as that of the plate cylinder 9*a*, an inking mechanism 13*a*, and a water supply mechanism 15*a*. The blanket cylinder 7*a*, the plate cylinder 9*a*, the inking mechanism 13*a*, and the water supply mechanism 15 are coupled, above the impression cylinder 11*a*.

The back surface printing unit 6*a* includes, similarly to the top surface printing unit 5*a*, a blanket cylinder 8*a*, a plate cylinder 10*a*, a sheet gripper (not shown), an impression cylinder 12*a* having the same diameter as that of the plate cylinder 10*a*, an inking mechanism 14*a*, and a water supply mechanism 16*a*. The blanket cylinder 8*a*, the plate cylinder 10*a*, the inking mechanism 14*a*, and the water supply mechanism 16*a* are coupled below the impression cylinder 12*a*.

The top surface printing unit 5*a* and the back surface printing unit 6*a*, formed as described above, are coupled to each other. When these two units are so coupled, the impression cylinders 11*a* and 12*a* constituting the printing units 5*a* and 6*a* are horizontally connected in series. In the alternative, the impression cylinders 11*a* and 12*a* may be connected such that a line connecting the centers of the impression cylinders extends obliquely. An ink dryer 17 is also arranged near each of the impression cylinders 11*a* and 12*a*.

With the structure described above, a sheet P is transferred from the transfer cylinder 4 to the impression cylinder 11*a* of the top surface printing unit 5*a* which pereforms printing on the top surface of the sheet P. Then, the sheet P is transferred to the impression cylinder 12*a* of the back surface printing unit 6*a* which performs printing on the back surface of the sheet P.

The perfecting sheet rotary offset press of this embodiment is also provided with a delivery cylinder 20 connected to the impression cylinder 12*a*; a sprocket 21; a delivery chain 22 having a gripper which is driven by the sprocket 21. The sheet P, after the completion of printing, is transferred from the impression cylinder 12*a* through the delivery cylinder 20 and is discharged onto a discharged sheet carrier 23 by the chain 22.

In the above, the impression cylinder 11*a* of the top surface printing unit 5*a* and the impression cylinder 12*a* of the back surface printing unit 6*a* have the same diameters as those of the plate cylinders 9*a* and 10*a*, respectively. However, in another embodiment, impression cylinders having diameters twice or more than the diameters of the plate cylinders 9*a* and 10*a* may be used. Also, the rear side of the back surface printing unit 6*a* may be occasionally used. Further, the top surface printing unit 5*a* may be connected behind the back surface printing unit 6*a*.

Figure 2:
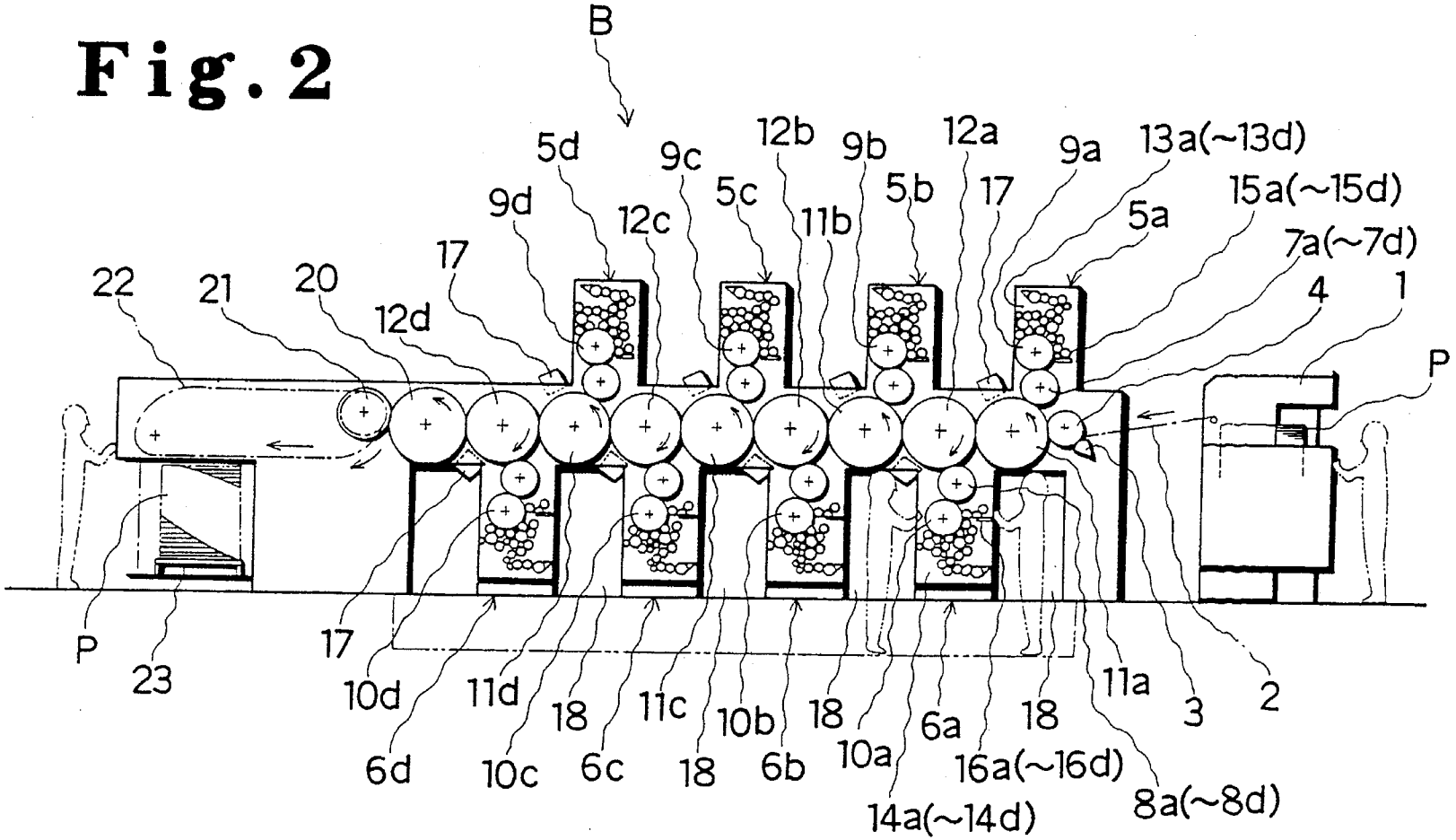
FIGS. 2–15 are lateral views showing second to fifteenth embodiments of the present invention.

FIG. 2 shows a second embodiment of a perfecting four-color sheet rotary offset press to which the present invention is applied. Sheets P piled in a feeder body 1 are fed one by one through a feeder board 2, a swinger 3, and a transfer cylinder 4 to a printing section B in which four-color printing is performed on both surfaces of the sheet P.

The printing section B is composed of four top surface printing units 5*a*–5*d* and four back surface printing units 6*a*–6*d* for four colors.

The top surface printing units 5*a*–5*d* for first to fourth colors each have an impression cylinder 11*a* of a diameter double that of the plate cylinder 9*a*. Likewise, the back surface printing units 6*a*–6*d* each have an impression cylinder 12*a* of a diameter double that of the plate cylinder 10*a*. Since the rest of each printing units 5*a*–5*d* and 6*a*–6*d* is constructed similarly to the top surface printing unit 5*a* and the back surface printing unit 6*a* of the first embodiment, respectively, the parts in FIG. 2 corresponding to those in FIG. 1 are designated with the same reference numerals, and detailed explanation thereof will be omitted.

The perfecting four-color sheet rotary offset press of the second embodiment alternately connects the top surface printing units 5*a*, 5*b*, 5*c*, 5*d* and the back surface printing units 6*a*, 6*b*, 6*c*, 6*d*, respectively in such a manner that the top surface printing unit 5*a* for the first color is first connected, the back surface printing unit 6*a* for the first color is connected next to the top surface printing unit 5*a*, and the top surface printing unit 5*b* for the second color is connected next to the back surface printing unit 6*a*, and so on. In this event, the impression cylinders 11*a*–11*d* and 12*a*–12*d* respectively constituting the printing units 5*a*–5*d* and 6*a*–6*d* are horizontally connected in series. As illustrated in FIG. 2, a line coupling the axial centers of the impression cylinders extends substantially in a linear path. However, it should be noted that in another embodiment, the impression cylinders 11*a*–11*d* and 12*a*–12*d* may be coupled such that a line connecting the centers thereof presents a zig-zag line. The perfecting press of the second embodiment is also provided with an ink dryer 17 arranged near each of the impression cylinders 11*a*–11*d* and 12*a*–12*d*.

With the above described structure, a sheet P is transferred from the transfer cylinder 4 to the impression cylinder 11*a* of the first surface printing unit 5*a* which performs printing on the surface of the sheet P in the first color. Then, the sheet P is transferred to the impression cylinder 12*a* of the first back surface printing unit 6*a* which performs printing on the back surface of the sheet P in the first color. Subsequently, printing is performed alternately on the surface and back surface of the sheet P in the first to fourth colors by the second to fourth top surface printing units 5*b*–5*d* and the second to fourth back surface printing units 6*b*–6*d*, similarly to the first color printing as described above.

Figure 3:
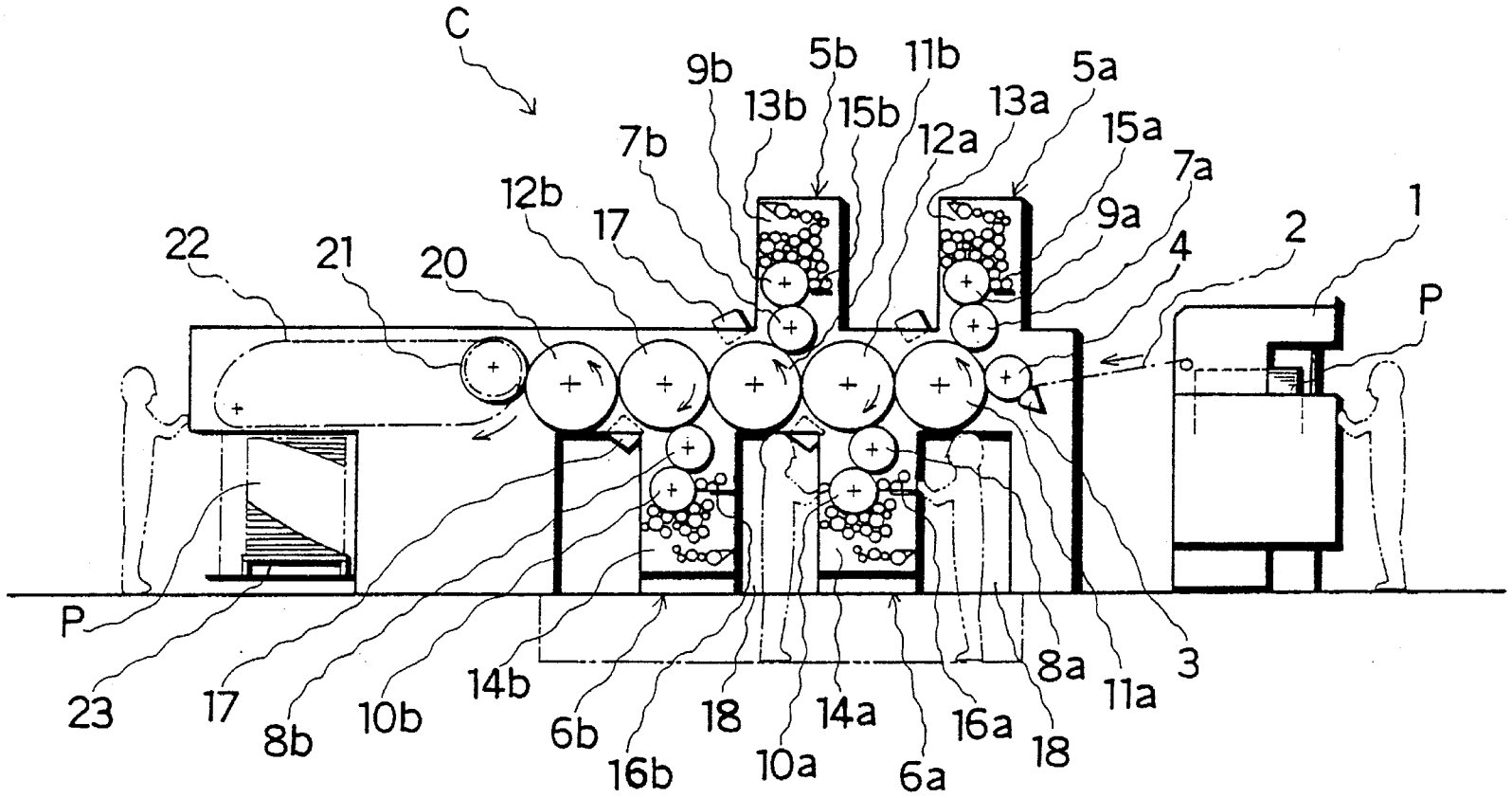

FIG. 3 shows in a schematic lateral view a perfecting two-color sheet rotary offset press according to a third embodiment of the present invention. In this embodiment, the printing section C employs first and second top surface printing units 5*a*, 5*b* and first and second back surface printing units 6*a*, 6*b*, which are similar to those used in the second embodiment. Impression cylinders 11*a*, 11*b*, 12*a*, and 12*b* constituting the respective printing units are horizontally connected in series. The rest of the structure of the third embodiment is identical to the corresponding structure of the second embodiment shown in FIG. 2, so that parts in FIG. 3 corresponding to those in FIG. 2 are designated with the same reference numerals, and detailed explanation thereof will be omitted.

Figure 4:
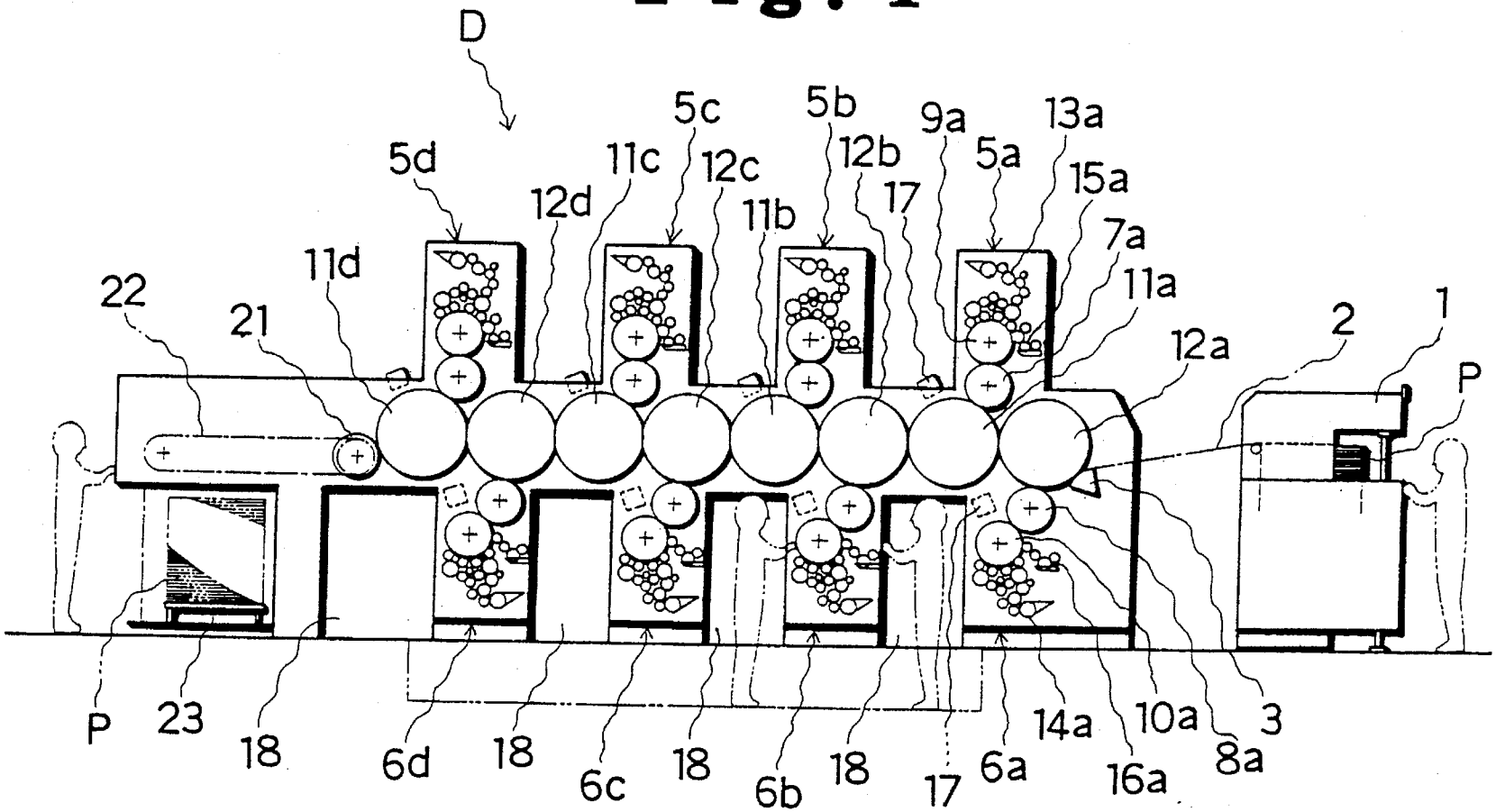

FIG. 4 is a schematic lateral view showing a perfecting four-color sheet rotary offset press according to a fourth embodiment of the present invention. In this embodiment, the printing section D employs four top surface printing units 5a–5d and four back surface printing units 6a–6d, similar to those used in the second embodiment. These printing units 5a–5d and 6a–6d are alternately connected in such a manner that the back surface printing unit 6a for the first color is placed close to a sheet feeder 1, followed by the top surface printing unit 5a for the first color, followed by the back surface printing unit 6b for the second color, and so on. Impression cylinders 11a–11d and 12a–12d constituting the respective printing units 5a–5d and 6a–6d are horizontally connected in series. With this structure, a sheet P is transferred from a feeder board 2 directly to the impression cylinder 12a of the first back surface printing unit 6a by means of the swinger 4 without a transfer cylinder 4. After the back surface of the sheet P has been printed in a first color by the back surface printing unit 6a, the sheet P is transferred to the impression cylinder 11a of the first top surface printing unit 5a which performs printing on the top surface of the sheet P in the first color. Subsequently, printing is performed alternately on the top surface and the back surface of the sheet P in second to fourth colors by the printing units 5b–5d and 6b–6d, similarly to the printing in the first color. Since the last impression cylinder 11d is rotated in the direction reverse to the rotating direction of the delivery chain 22 having a gripper, the sheet P, after completing the printing in the fourth color, is directly transferred to the delivery chain 22 without a delivery cylinder 20, and then discharged onto a discharged sheet carrier 23. Since the rest of the structure of the fourth embodiment is identical to the corresponding parts of the second embodiment shown in FIG. 2, the parts in FIG. 4 corresponding to these in FIG. 2 are designated with the same reference numerals, and detailed explanation thereof will be omitted. It will be understood that in the fourth embodiment, from which the transfer cylinder 4 and the delivery cylinder 20 are removed, the structure is correspondingly simplified, and the length of the machine is shortened.

Figure 5:
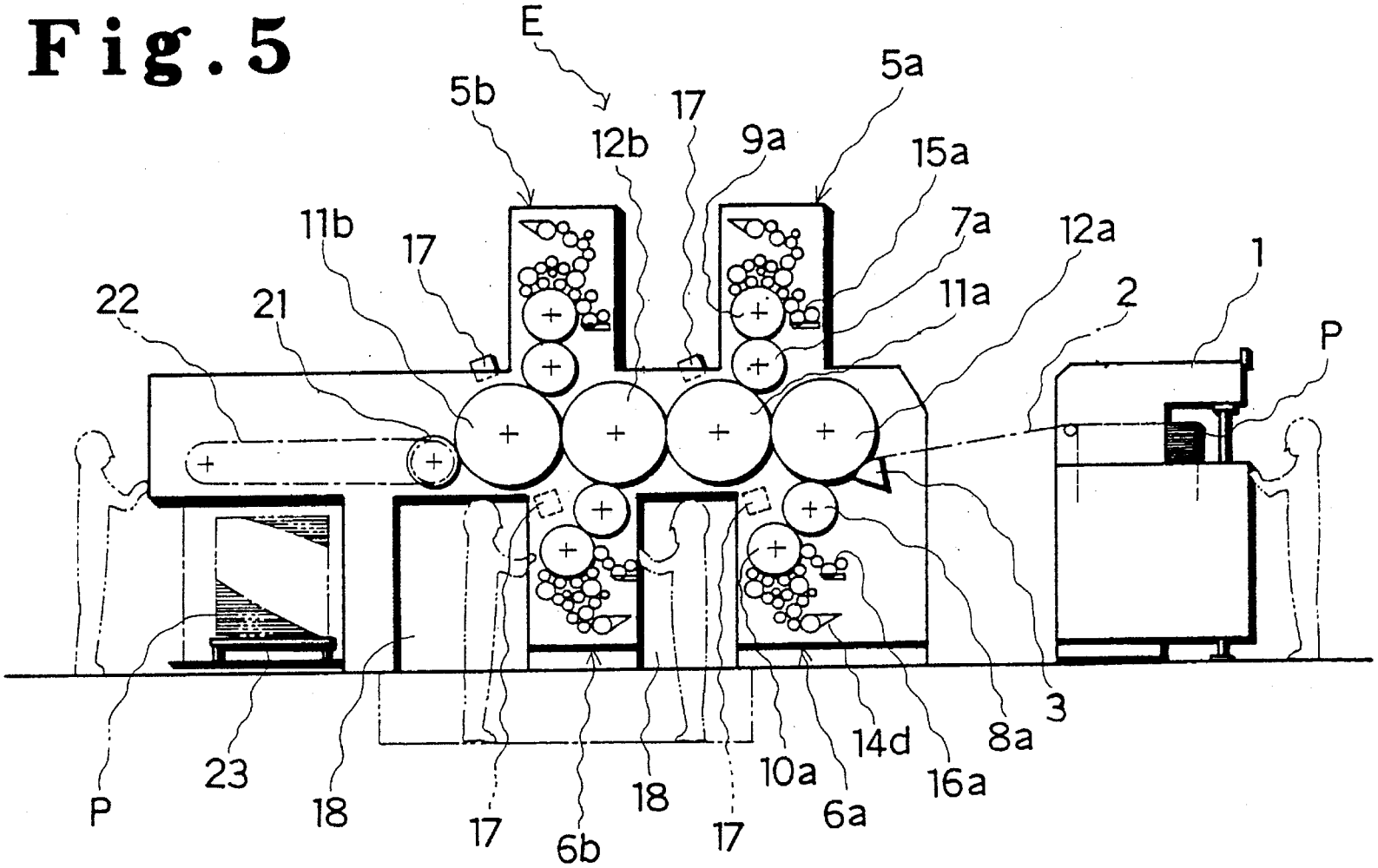

FIG. 5 is a schematic lateral view showing a perfecting two-color sheet rotary offset press according to a fifth embodiment of the present invention. In the fifth embodiment, a printing section E employs first and second back surface printing units 6a, 6b and first and second top surface printing units 5a, 5b, similar to those used in the fourth embodiments. Impression cylinders 11a, 11b, 12a, and 12b constituting the respective printing units are horizontally connected in series. The rest of the structure in the fifth embodiment is the same as that of the fourth embodiment, so that the parts in FIG. 5 corresponding to those in FIG. 4 are designated with the same reference numerals, and detailed explanation thereof will be omitted.

It should be noted that, as shown in FIGS. 1–5, maintenance and other operations can be carried out for the back surface printing units 6a–6d in each space 18 between adjacent printing units.

Figure 6:
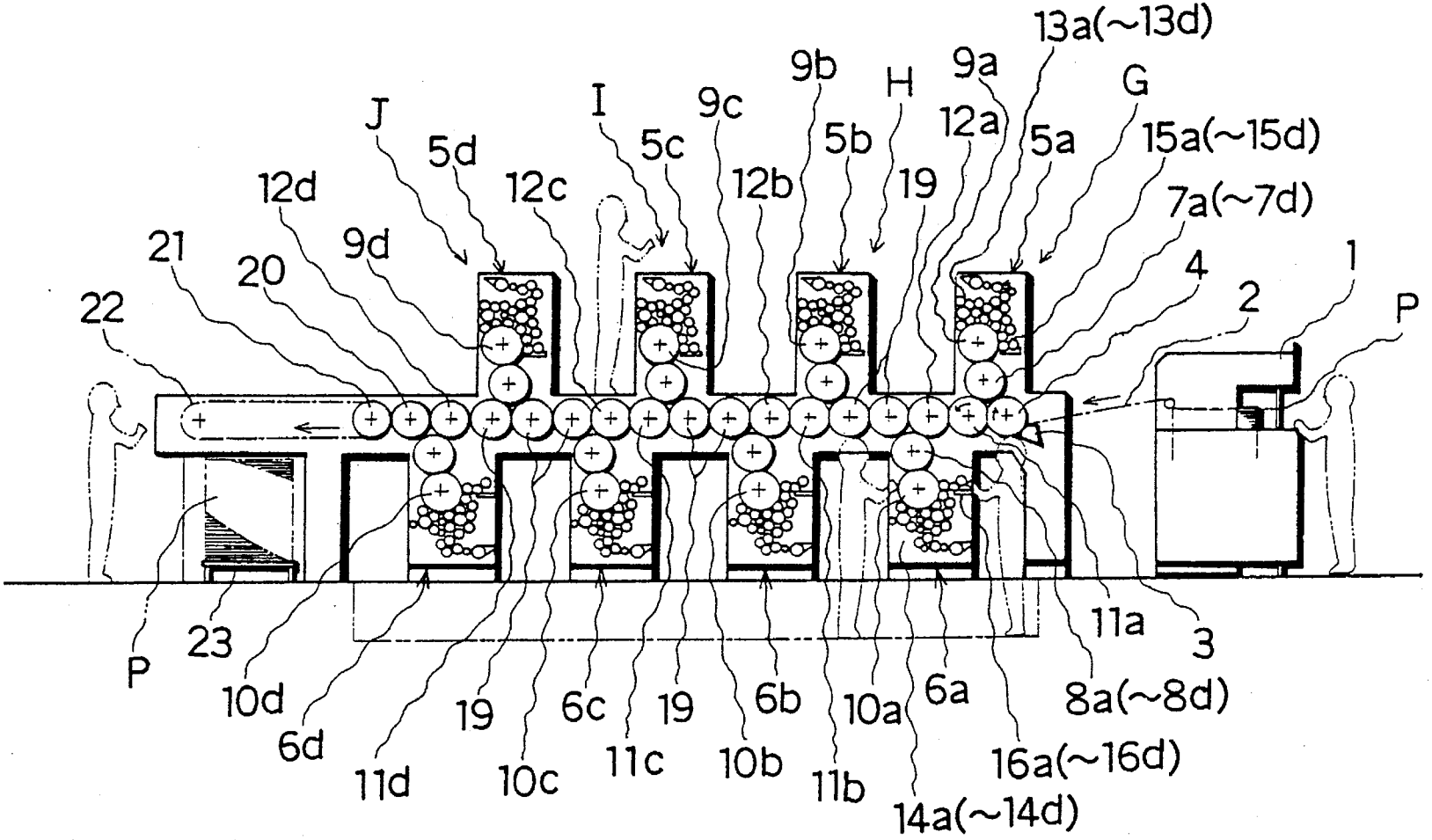

FIG. 6 is a schematic lateral view of a perfecting four-color sheet rotary offset press according to a sixth embodiment of the present invention. Sheets P piled in a feeder body 1 are one by one fed through a feeder board 2, a swinger 3 and a transfer cylinder 4 to a printing section which performs printing on both surfaces of the sheet P in four colors.

Since four identical top surface printing units 5a–5d and four identical back surface printing units 6a–6d are arranged in the printing section only, the top surface printing unit 5a for a first color and the back surface printing unit 6a for the first color only will be explained below for the sake of convenience.

The top surface printing unit 5a includes a blanket cylinder 7a, a plate cylinder 9a, a sheet gripper (not shown), an impression cylinder 11a having the same diameter as that of the plate cylinder 9a, an inking mechanism 13a, and a water supply mechanism 13a. The blanket cylinder 7a, the plate cylinder 9a, the inking mechanism 13a, and the water supply mechanism 15a are connected in series above the impression cylinder 11a.

The back surface printing unit 6a in turn includes a blanket cylinder 8a, a plate cylinder 10a, a sheet gripper (not shown), an impression cylinder 12a having the same diameter as that of the plate cylinder 10a, an inking mechanism 14a, and a water supply mechanism 16a, similarly to the top surface printing unit 5a. The blanket cylinder 8a, the plate cylinder 10a, the inking mechanism 14a, and the water supply mechanism 16a are connected in series below the impression cylinder 12a.

The impression cylinder 12a of the back surface printing unit 6a is horizontally connected behind the impression cylinder 11a of the top surface printing unit 5a, thus as shown in FIG. 6 constructing the top and back surface printing unit G for the first color. Top and back surface printing units H–J for second to fourth colors are constructed similarly to the top and back surface printing unit G for the first color, so that a detailed explanation thereof will be omitted.

The perfecting four-color sheet rotary offset press of this embodiment has the four top and back surface printing units G–J for the first to fourth colors horizontally connected through two intermediate cylinders 19 arranged between each two adjacent units. In this structure, the top and back surface printing units G–J for the first to fourth colors are connected in series such that impression cylinders 11a–11d constituting the respective top surface printing units 5a–5d; impression cylinders 12a–12d constituting the respective back surface printing units 6a–6d; and the six intermediate cylinders 19 have the centers thereof aligned substantially linear. It should be noted however that in another embodiment, the top and bottom surface printing units G–J are connected in series such that a line connecting the axial centers of the respective cylinders presents a zig-zag line.

With the structure described above, a sheet P is transferred from the transfer cylinder 4 to the impression cylinder 11a of the top surface printing unit 5a constituting the top and back surface printing unit G for the first color which performs printing on the top surface of the sheet P in the first color. Then, the sheet P is transferred to the impression cylinder 12a of the back surface printing unit 6a which performs printing on the back surface of the sheet P in the first color. Subsequently, the sheet P is transferred through the two intermediate cylinders 19 to the top and back surface printing unit H for the second color, and then sequentially to the top and back surface printing units I and J for the third and fourth colors, whereby printing is performed on the top and back surfaces of the sheet P in the second to fourth colors.

Figure 7:
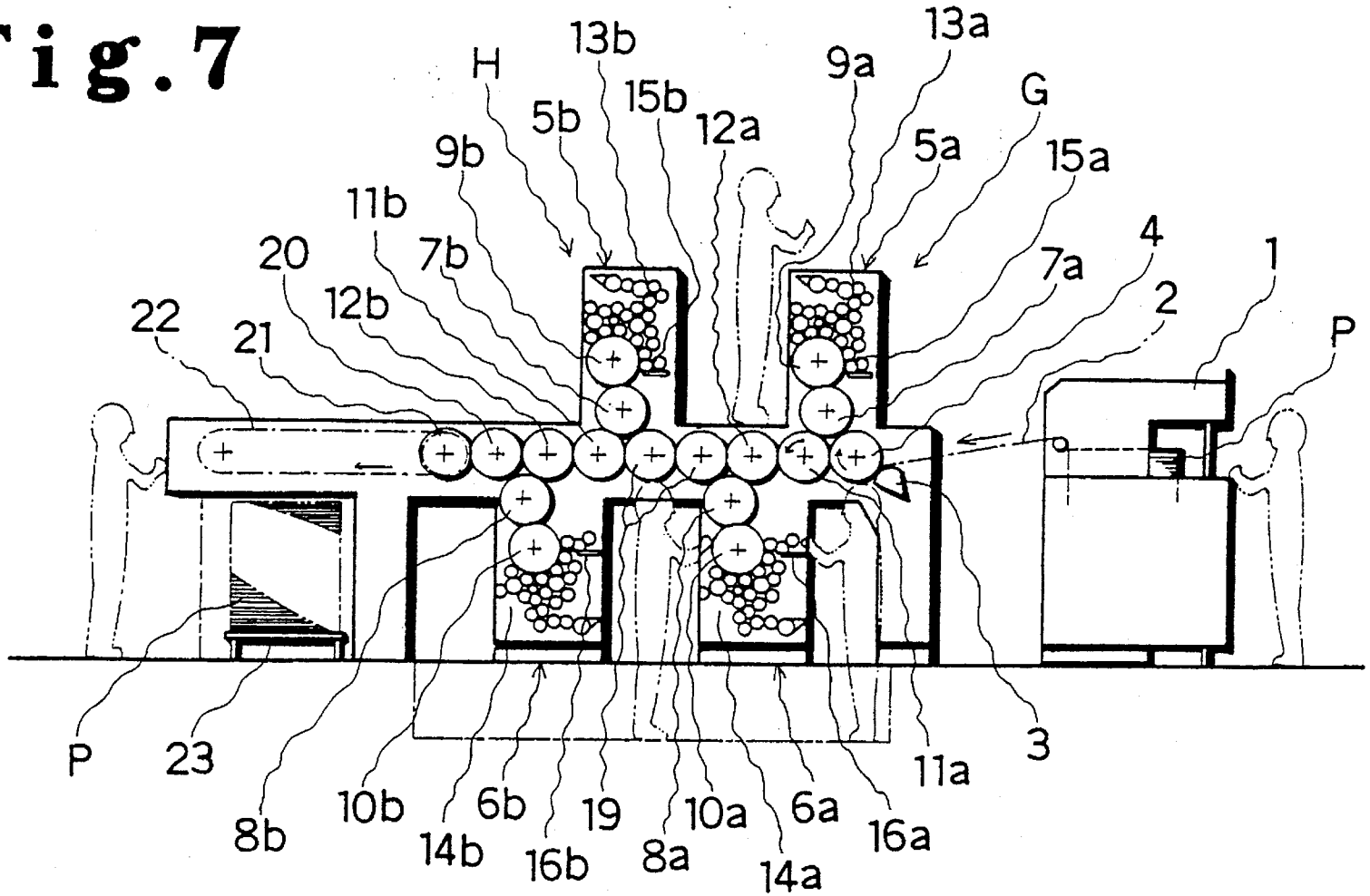

In FIG. 7 a perfecting two-color sheet rotary offset press according to a seventh embodiment of the present invention is shown. In this embodiment, the printing section employs the top and back surface printing units G, H for the first and second colors which have been used in the sixth embodiment, wherein the impression cylinders 11a, 12a, 11b, 12b and the intermediate cylinders 19 are horizontally connected. With this structure, a sheet P is transferred sequentially to the impression cylinders 11a, 12a, the two intermediate cylinders 19, and the impression cylinders 11b, 12b, during which printing can be performed on the top and back surfaces of the sheet P in two colors. The rest of the structure of the seventh embodiment is identical to the corresponding structure of the sixth embodiment shown in FIG. 6, so that the parts in FIG. 7 corresponding to those in FIG. 6 are designated with the same reference numerals, and detailed explanation thereof will be omitted.

Figure 8:
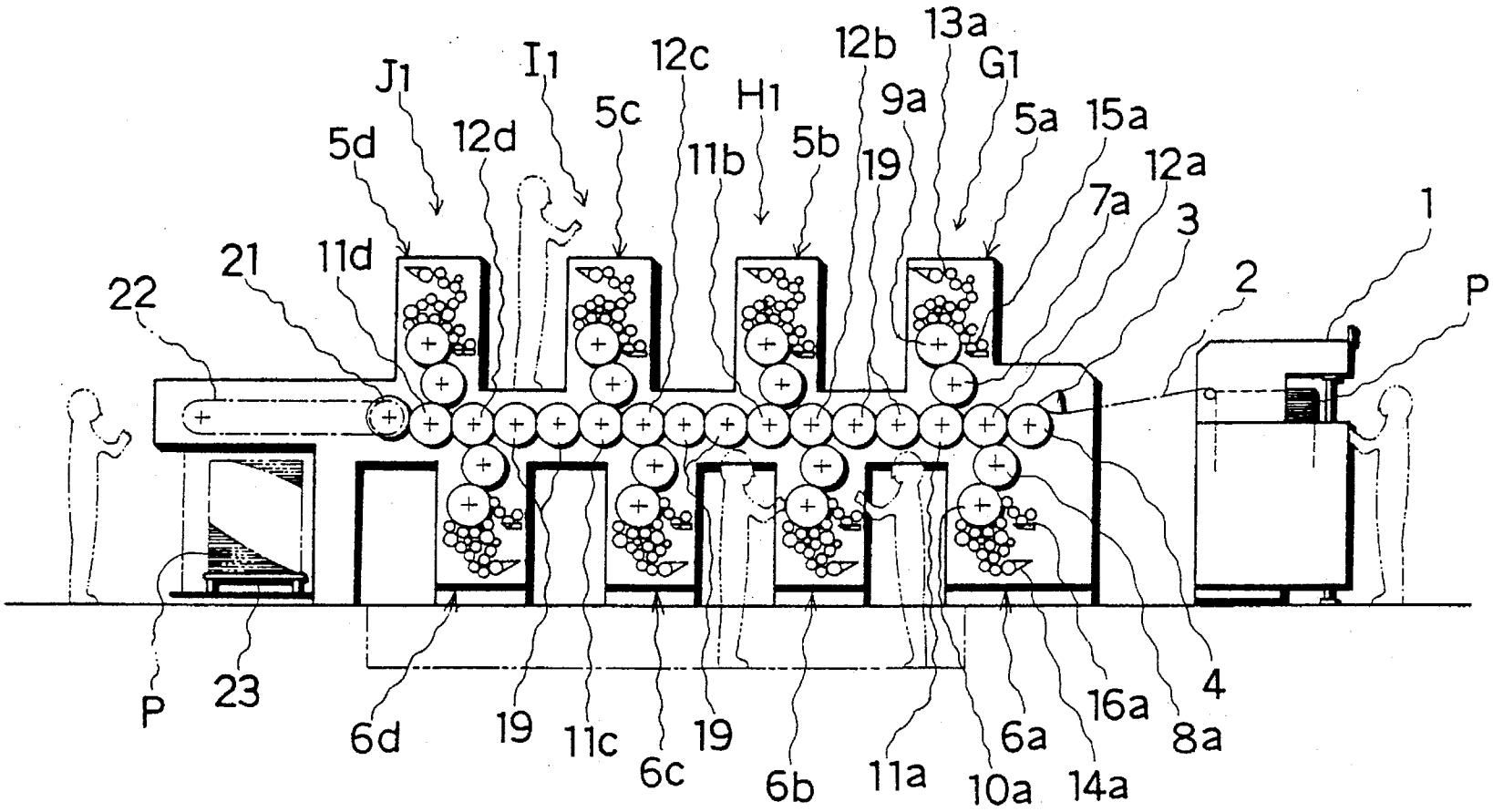

In FIG. 8 a perfecting four-color sheet rotary offset press according to an eighth embodiment of the present invention is illustrated. In this embodiment, the printing section employs top surface printing units 5*a*–5*d* and back surface printing units 6*a*–6*d*, similar to those of the sixth embodiment. Specifically, each of the top surface printing units 5*a*–5*d* is connected behind each of the back surface printing units 6*a*–6*d* to form top and back surface printing units G1, H1, I1, J1 for first-fourth colors. These printing units are horizontally connected through two intermediate cylinders 19 arranged between adjacent printing units. With this structure, a sheet P is transferred from a transfer cylinder 4 to an impression cylinder 12*a* of the back surface printing unit 6*a* constituting the the top and back surface printing unit G1 for the first color, wherein the sheet P is subjected to printing on its back surface in the first color. Then, the sheet P is transferred to an impression cylinder 11*a* of the top surface printing unit 5*a* which performs printing on the top surface of the sheet P in the first color. Subsequently, the sheet P is sequentially fed through the two intermediate cylinders 19 to the top and back surface printing units H1, I1, J1 for the second, third, and fourth colors, wherein printing is performed on the top and back surfaces of the sheet P in the second to fourth colors as the sheet P passes through the respective printing units. Since the final impression cylinder 11*d* is rotated in the direction reverse to the rotation of a delivery chain 22, the sheet P, after completing the printing in the fourth color, can be directly transferred to the delivery chain 22 having a gripper without a delivery cylinder 20, and then discharged onto a discharged sheet carrier 23. The rest of the structure of the eighth embodiment is identical to the corresponding structure of the sixth embodiment shown in FIG. 6, so that the parts in FIG. 8 corresponding to those in FIG. 6 are designated with the same reference numerals, and detailed explanation thereof will be omitted. It will be understood that in the eighth embodiment, from which the transfer cylinder 4 and the delivery cylinder 20 are removed, the structure is correspondingly simplified, and the length of the machine is shortened. Also, the use of an upper swinger 3 may permit the transfer cylinder 4 to be removed.

Figure 9:
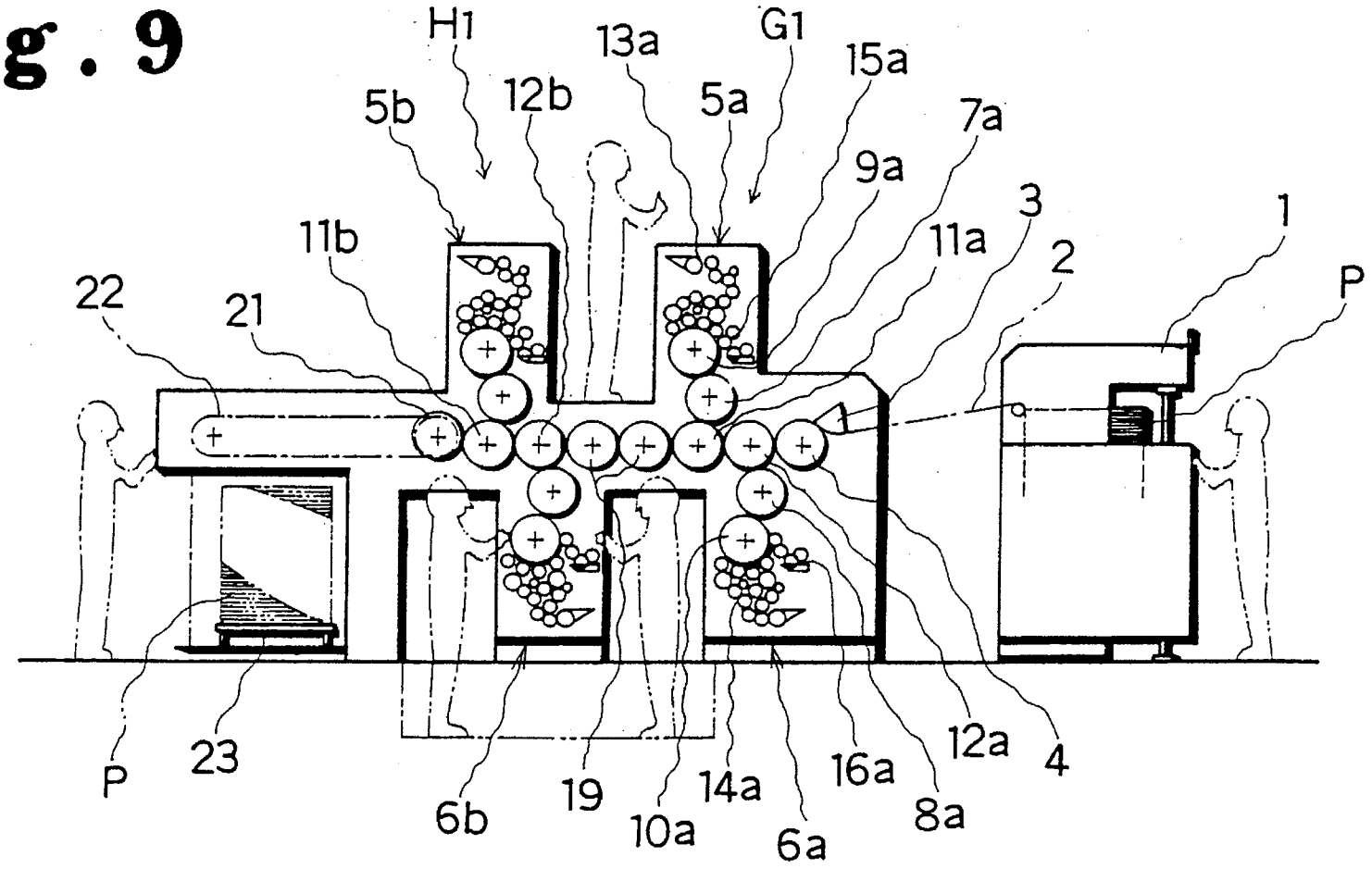

FIG. 9 illustrates a perfecting two-color sheet rotary offset press according to a ninth embodiment of the present invention. In this embodiment, a printing section employs the top and back surface printing units G1, H1 for first and second colors of the eighth embodiment shown in FIG. 8. Specifically, the printing section is constructed with impression cylinders 12*a*, 11*a*, 12*b*, 11*b* and intermediate cylinders 19 which are all connected horizontally. This structure allows a sheet P to be sequentially transferred to the impression cylinders 12*a* and 11*a*, the two intermediate cylinders 19, and the impression cylinders 12*b* and 11*b*. The sheet P is subjected to printing on top and back surfaces thereof in two colors as it passes through these printing units. The rest of the structure of the ninth embodiment is identical to the corresponding structure of the eighth embodiment shown in FIG. 8, so that the parts in FIG. 9 corresponding to those in FIG. 8 are designated with the same reference numerals, and detailed explanation thereof will be omitted. It should be noted that the transfer cylinder 4 may be removed if an upper swinger 3 is used.

When the impression cylinders 11*a*–11*d* and 12*a*–12*d* and the two intermediate cylinders 19 each have the same diameter as the plate cylinders 9*a*–9*d* and 10*a*–10*d* are horizontally connected, as shown in FIGS. 6, 7, 8, and 9, the height of the press can be reduced to a minimum. As described above, the top surface printing unit 5*a* and the back surface printing unit 6*a* constitute a unit of top and back surface printing unit G, G1. Likewise, a plurality of top and back surface printing units H, H1, I, I1, J, J1 are connected respectively through the two intermediate cylinders 19, so that spaces for maintenance and other works are formed between adjacent ones of the plurality of top surface printing units 5*a*–5*d* and back surface printing units 6*a*–6*d*.

Figure 10:
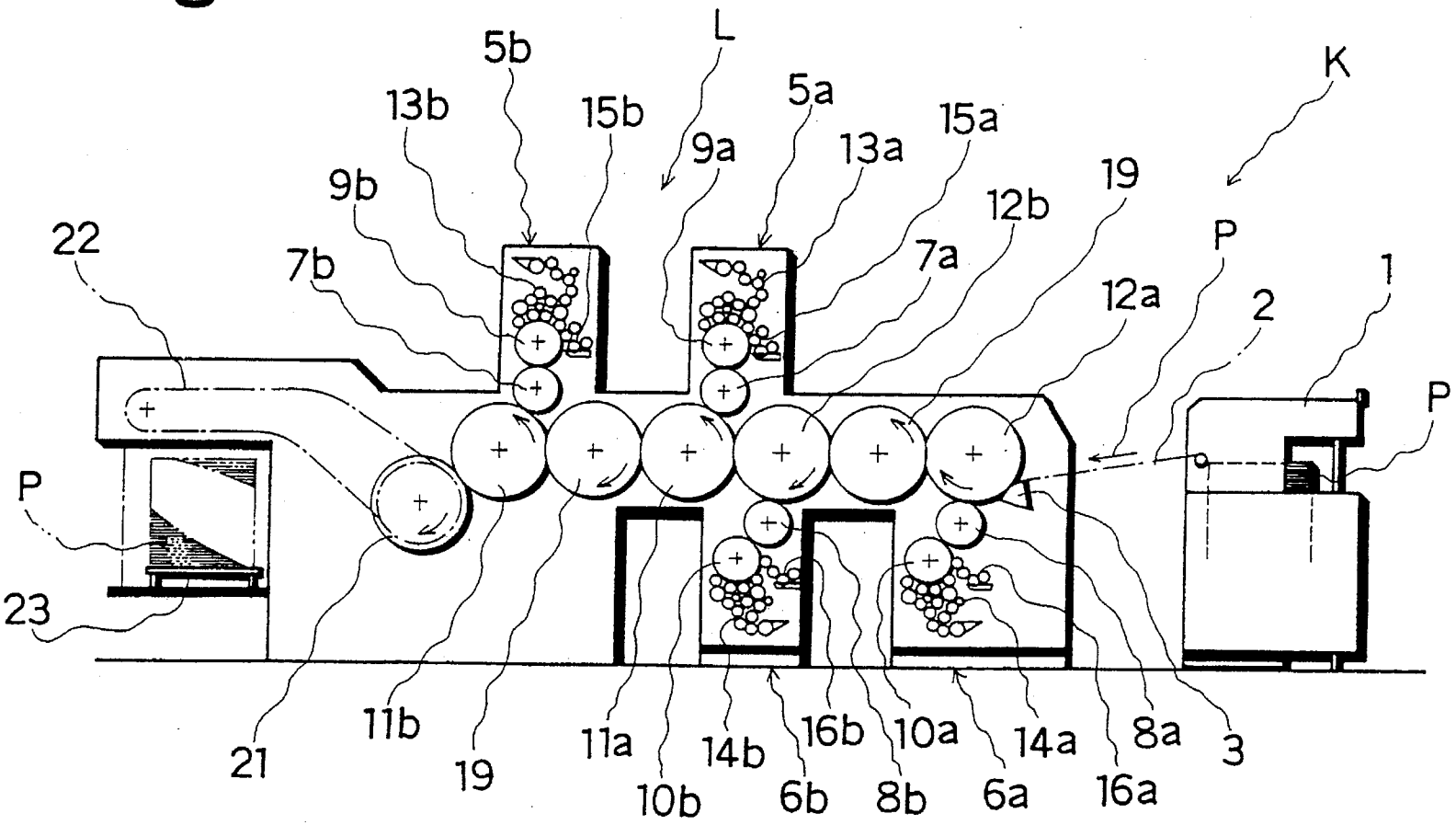

FIG. 10 shows a perfecting two-color sheet rotary offset press according to a tenth embodiment of the present invention. This embodiment arranges a top surface printing section L including juxtaposed top surface printing units 5*a*, 5*b* for first and second colors behind a back surface printing section K including juxtaposed back surface printing units 6*a*, 6*b* for the first and second colors, such that a line connecting the axes of impression cylinders constituting the respective printing sections K and L extends substantially in the horizontal direction.

The back surface printing units 6*a*, 6*b* for the first and second colors includes blanket cylinders 8*a*, 8*b*; plate cylinders 10*a*, 10*b*; intermediate cylinders having sheet grippers (not shown); impression cylinders 12*a*, 12*b* having the diameters double the diameters of the plate cylinders 10*a*, 10*b*, respectively; inking mechanisms 14*a*, 14*b*; and water supply mechanisms 16*a*, 16*b*. Below the impression cylinders 12*a*, 12*b*, the blanket cylinders 8*a*, 8*b*, the plate cylinders 10*a*, 10*b*, the inking mechanisms 14*a*, 14*b*, and the water supply mechanisms 16*a*, 16*b* are connected in series, respectively. The back surface printing section K is formed by the impression cylinders 12*a*, 12*b* of the back surface printing units 6*a*, 6*b* for the first and second colors substantially linearly connected in the horizontal direction through the intermediate cylinders 19 having the sheet grippers (not shown).

The top surface printing units 5*a*, 5*b* for the first and second colors, like the back surface printing units 6*a*, 6*b*, includes blanket cylinders 7*a*, 7*b*; plate cylinders 9*a*, 9*b*; intermediate cylinders 19 having sheet grippers (not shown); impression cylinders 11*a*, 11*b* having the diameters double the diameters of the plate cylinders 9*a*, 9*b*; inking mechanisms 13*a*, 13*b*; and water supply mechanisms 15*a*, 15*b*. Above the impression cylinders 11*a*, 11*b*, the blanket cylinders 7*a*, 7*b*, the plate cylinders 9*a*, 9*b*, the inking mechanisms 13*a*, 13*b*, and the water supply mechanisms 15*a*, 15*b* are connected in series, respectively. Also, the top surface printing section L is formed by the impression cylinders 11*a*, 11*b* of the top surface printing units 5*a*, 5*b* for the first and second colors substantially linearly connected in the horizontal direction through the intermediate cylinders 19 having the sheet grippers (not shown).

Sheets P piled in a feeder body 1 are fed one by one through a feeder board 2 and swinger 3 to the impression cylinder 12*a* of the back surface printing unit 6*a* for the first color in the back surface printing section K, in which printing is performed on the back surface of the sheet P in the first color. Then, the sheet P is transferred to the impression cylinder 12*b* of the back surface printing unit 6*a* for the second color through the intermediate plate 19, and printing is performed on the back surface of the sheet P in the second color by the back surface printing unit 6*a*.

Subsequently, the sheet P is transferred from the impression cylinder 12*b* of the back surface printing unit 6*a* to the impression cylinder 11*a* of the top surface printing unit 5*a* for the first color in the top surface printing section L, in which printing is performed on the top surface of the sheet P in the first color. Next, the sheet P is transferred to the impression cylinder 11*b* of the top surface printing unit 5*a* for the second color. In this manner, the sheet P has both surfaces printed in two colors. After the completion of the printing, the sheet P is discharged from the impression cylinder 11*b* at the end onto a discharged sheet carrier 23 by a delivery chain 22 having a gripper.

Figure 11:
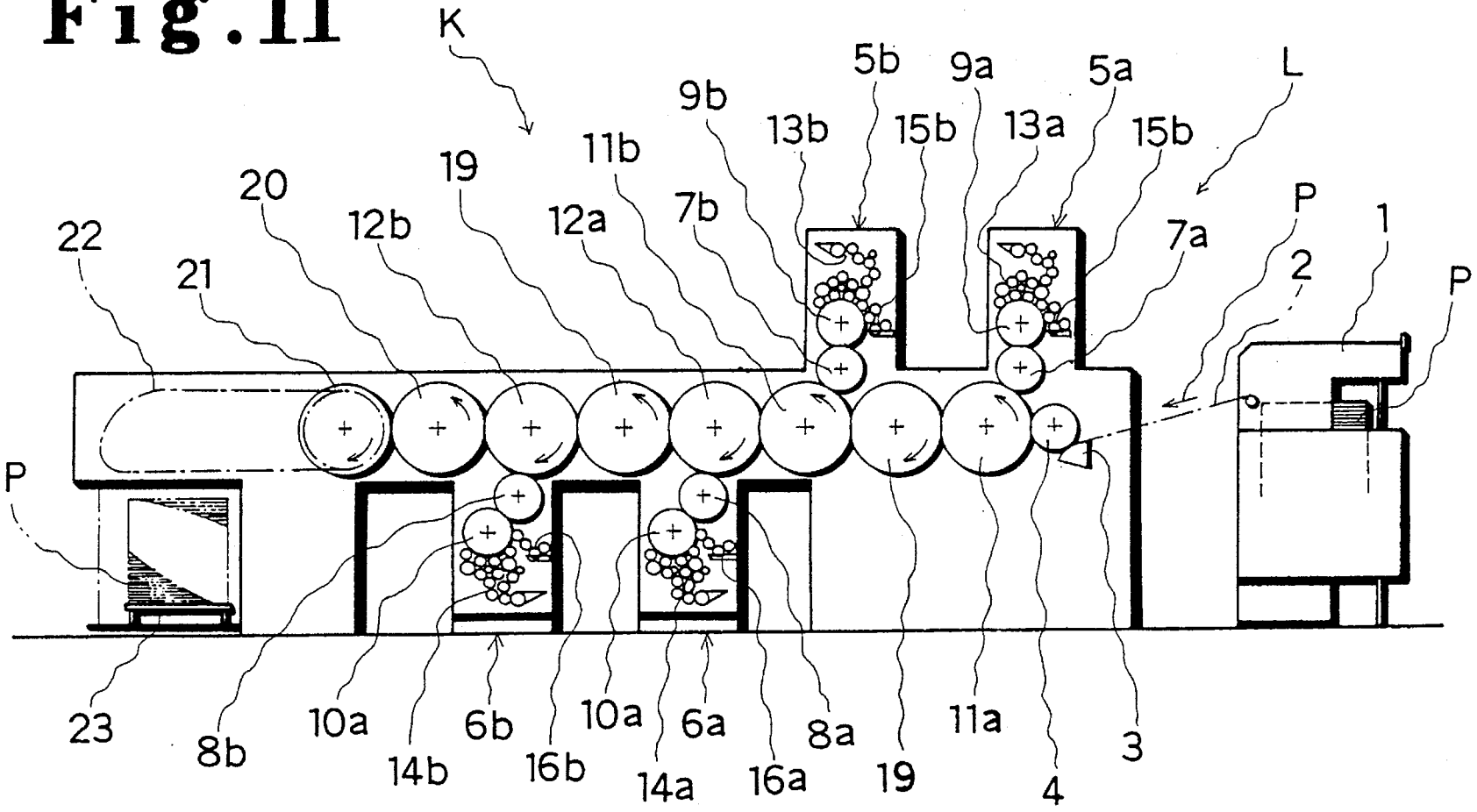

FIG. 11 shows a perfecting two-color sheet rotary offset press according to an eleventh embodiment of the present invention. While the eleventh embodiment is similar to the tenth embodiment, they differ in that the former has a back surface printing section K having juxtaposed back surface printing units 6*a*, 6*b* for first and second colors connected behind a top surface printing section L having juxtaposed top surface printing units 5*a*, 5*b* for the first and second colors.

Since the top surface printing section L and the back surface printing section K of the eleventh embodiment are substantially the same as the top surface printing section L and the back surface printing section K of the tenth embodiment shown in FIG. 10, the parts in FIG. 11 corresponding to those in FIG. 10 are designated with the same reference numerals, and detailed explanation thereof will be omitted.

In the eleventh embodiment, after printing has been first performed on the top surface of a sheet P in two colors by the top surface printing section L, the sheet P is transferred to the back surface printing section K, in which printing is performed on the back surface of the sheet p in the two colors. The press shown in FIG. 11 also includes a transfer cylinder 4 disposed between the swinger 3 and the impression cylinder 11*a* of the top surface printing unit 5*a* for the first color; and a delivery cylinder 10. It should be noted that the transfer cylinder 4 may be removed if an upper swing is used.

While the above embodiment has been explained in connection with a perfecting two-color sheet rotary offset press, it will be understood that the present invention is also applicable to a perfecting press for more than two colors.

Figure 12:
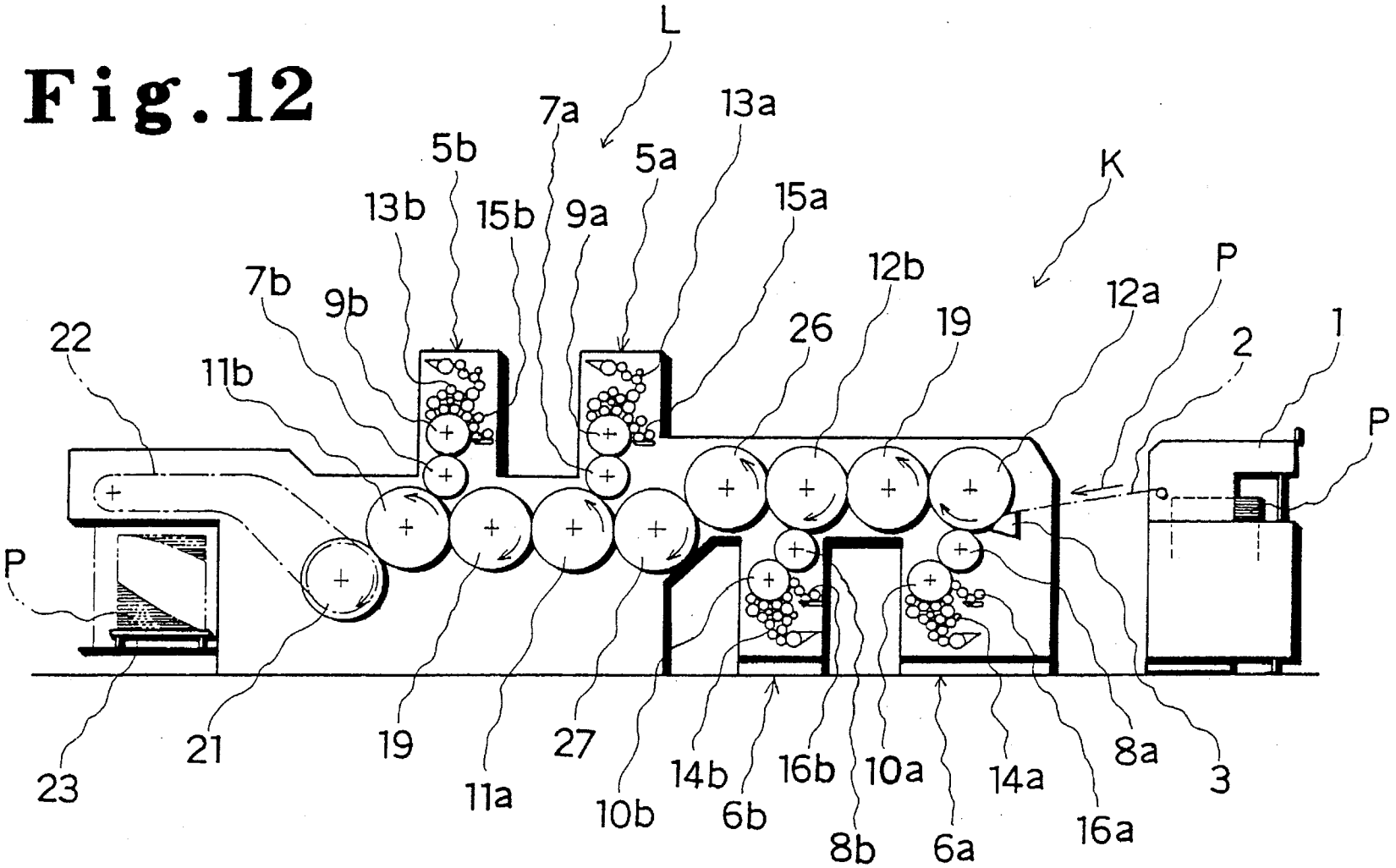

FIG. 12 illustrates a perfecting two-color sheet rotary offset press according to a twelfth embodiment of the present invention. In this embodiment, a top surface printing section L having juxtaposed top surface printing units 5*a*, 5*b* for first and second colors is connected behind a back surface printing section K having juxtaposed back surface printing units 6*a*, 6*b* for the first and second colors through two sheet transfer cylinders 26, 27.

Since the back surface printing section K and the top surface printing section L are substantially the same as the back surface printing section K and the top surface printing section L shown in FIG. 10 or 11, parts in FIG. 12 corresponding to those in FIG. 10 or 11 are designated with the same reference numerals, and detailed explanation thereof will be omitted.

It should be noted however that in the twelfth embodiment, the back surface printing section K is connected with the top surface printing section L through the sheet transfer cylinders 26, 27 such that the impression cylinders 11*a*, 11*b* and the intermediate cylinder 19 are positioned at a level lower than the level of the impression cylinders 12*a*, 12*b* and the intermediate cylinder 19.

Figure 13:
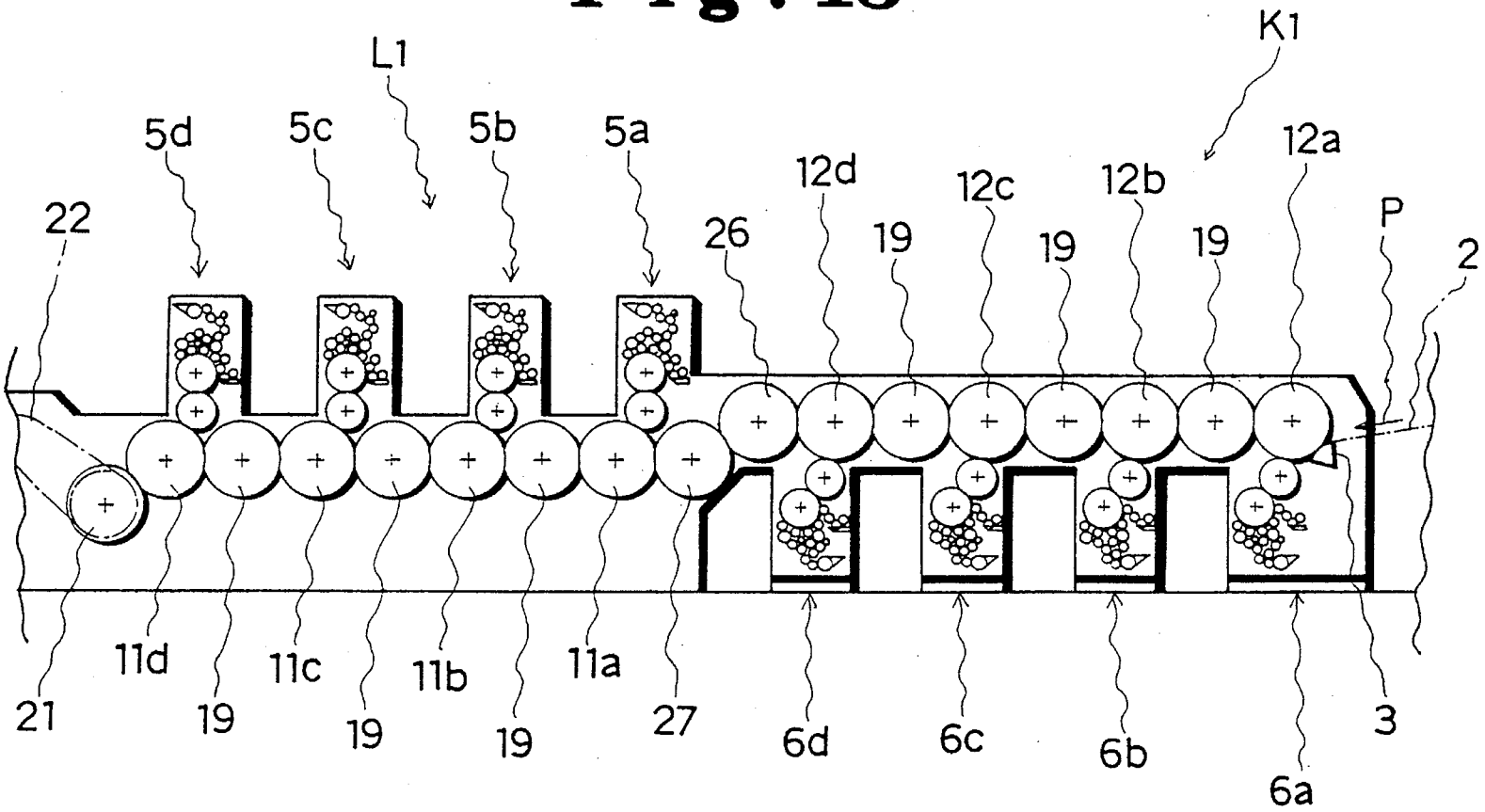

FIG. 13 illustrates a perfecting four-color sheet rotary offset press according to a thirteenth embodiment of the present invention which is a modification of the tenth embodiment illustrated in FIG. 10. In this embodiment, a top surface printing section L1 having juxtaposed top surface printing units 5*a*–5*d* for first to fourth colors is connected to a back surface printing section K1 having juxtaposed back surface printing units 6*a*–6*d* for the first to fourth colors through two sheet transfer cylinders 26, 27.

The back surface printing units 6*a*–6*d* for the first to fourth colors are all identical, and are the same as the identical back surface printing units 6*a*, 6*b* for the first and second colors in the tenth embodiment, while the top surface printing units 5*a*–5*d* for the first to fourth colors are also identical, and are the same as the identical top surface printing units 5*a*, 5*b* for the first and second colors in the tenth embodiment. The back surface printing section K1 is formed by connecting impression cylinders 12*a*–12*d* of the respective back surface printing units 6*a*–6*d* through three intermediate cylinders 19 as shown in FIG. 13. Likewise, the top surface printing section L1 is formed by connecting impression cylinders 11*a*–11*d* of the respective top surface printing units 5*a*–5*d* through three intermediate cylinders. Since the rest of the structure of the thirteenth embodiment is the same as the tenth embodiment shown in FIG. 10, detailed explanation thereof will be omitted.

With the above described structure, after printing has been performed first on the back surface of a sheet P in four colors by the back surface printing section K1, the sheet P is transferred to the top surface printing section L1 through the two sheet transfer cylinders 26, 27. Thus, printing is performed on the top surface of the sheet P in four colors by the top surface printing section L1.

Figure 14:
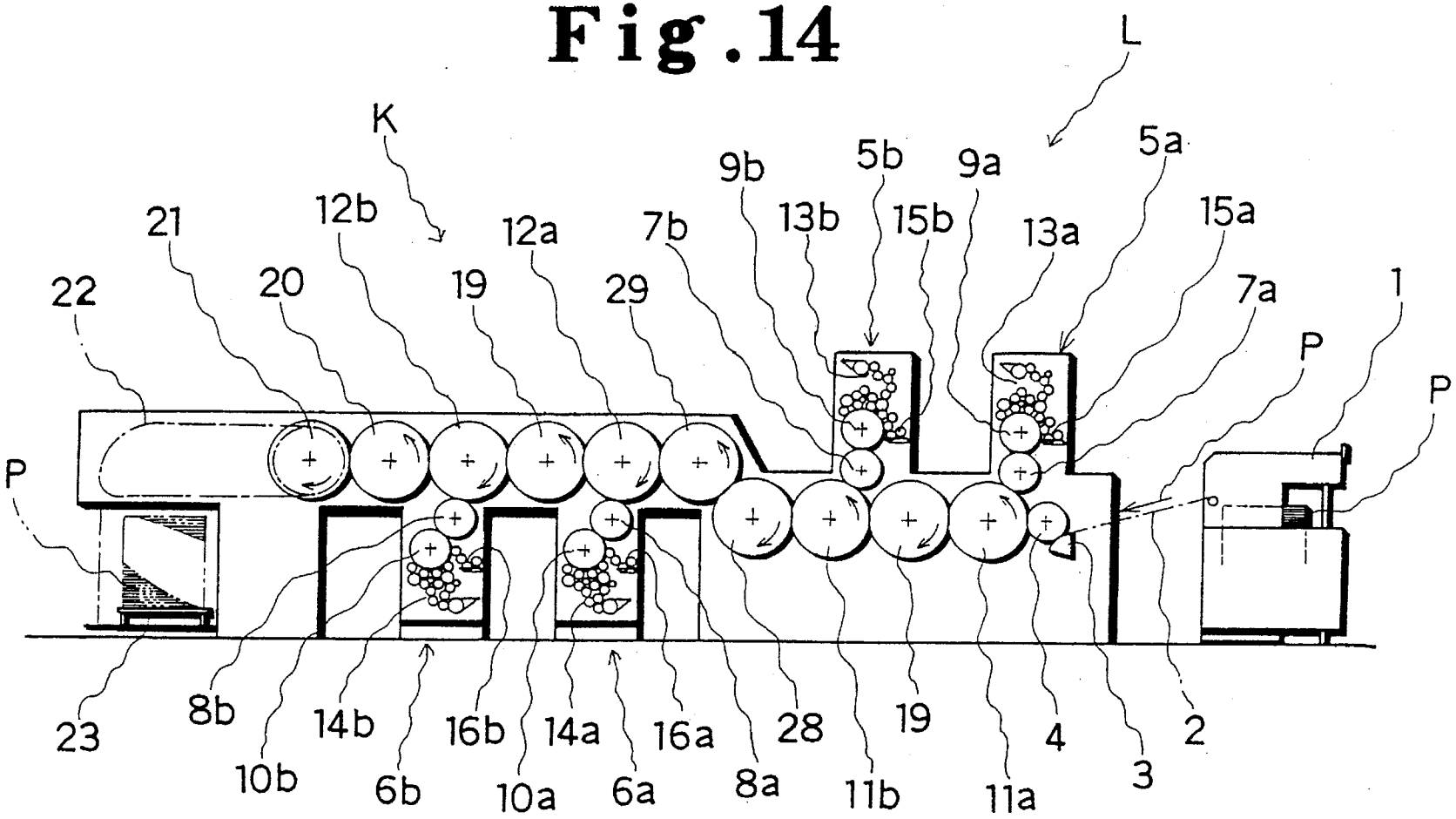

FIG. 14 shows a perfecting two-color sheet rotary offset press according to a fourteenth embodiment of the present invention. In this embodiment, a back surface printing section K having juxtaposed back surface printing units 6*a*, 6*b* for first and second colors is connected behind a top surface printing section L having juxtaposed top surface printing units 5*a*, 5*b* for the first and second colors through two sheet transfer cylinders 28, 29. The relationship of connecting positions is the same as that of the tenth embodiment.

Since the top surface printing section L and the back surface printing section K in FIG. 14 are substantially the same as the top surface printing section L and the back surface printing section K in the tenth embodiment shown in FIG. 10, parts in FIG. 14 corresponding to those in FIG. 10 are designated the same reference numerals, and detailed explanation thereof will be omitted.

In this embodiment, after printing has been performed first on the top surface of a sheet P in two colors by the top surface printing section L, the sheet P is transferred to the back surface printing section K through the two sheet transfer cylinders 28, 29, and printing is performed on the back surface of the sheet P in two colors by the back surface printing section K. The press of the fourteenth embodiment also includes a transfer cylinder 4 disposed between a swinger 3 and an impression cylinder 11*a* of the top surface printing unit 5*a* for the first color; and a delivery cylinder 20. It should be noted that the transfer cylinder 4 may be removed if an upper swing is used.

Figure 15:
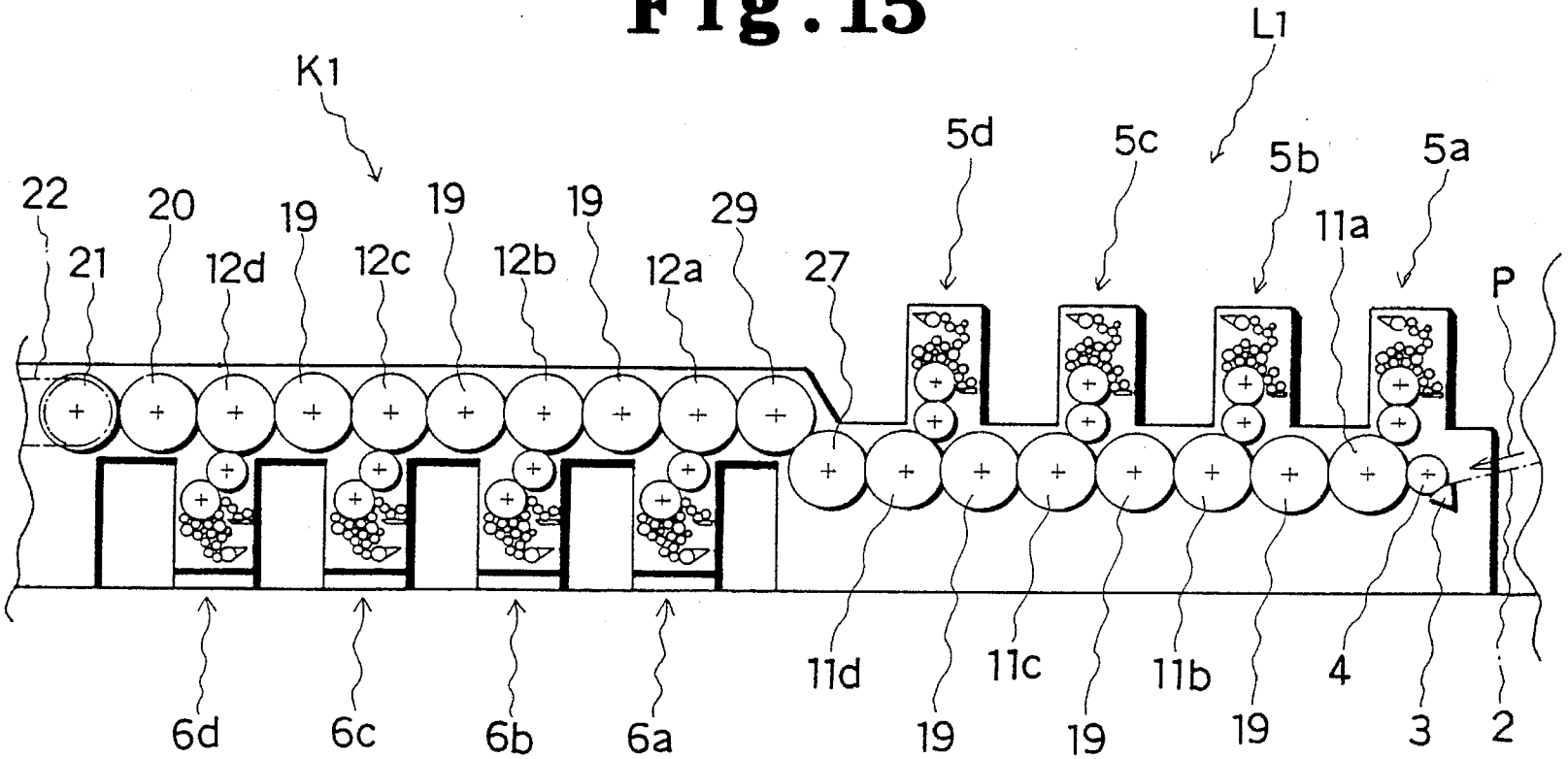

In FIG. 15 there is shown a perfecting four-color sheet rotary offset press according to a fifteenth embodiment of the present invention which is an modification of the fourteenth embodiment illustrated in FIG. 14.

In this embodiment, a top surface printing section L1 is formed by impression cylinders 11*a*–11*d* of top surface printing units for first to fourth colors connected through three intermediate cylinders 19, similarly to the eleventh embodiment described above. A back surface printing section K1 in turn is formed by impression cylinders 12*a*–12*d* of back surface printing units 6*a*–6*d* for the first to fourth colors connected through three intermediate cylinders 19 in a similar manner.

The back surface printing section K1 is connected behind the top surface printing section L1 through two sheet transfer cylinders 27, 29. After printing has been performed first on the top surface of a sheet P in four color by the top surface printing section L1, the sheet P is transferred to the back surface printing section K1 through the two sheet transfer cylinders 27, 29, and printing is performed on the back surface of the sheet P in four colors by the back surface printing section K1. The rest of the structure of the fifteenth embodiment is the same as the fourteenth embodiment shown in FIG. 14.

It will be understood that the height of the press can be reduced by connecting the back surface printing sections K, K1 with the top surface printing sections L, L1 such that the impression cylinders 11*a*–11*d* of the top surface printing sections L, L1 and the intermediate cylinders 19 are positioned at a level lower than the level of the impression cylinders 12*a*–12*d* of the back surface printing sections K, K1 and the intermediate cylinders 19.

Since the sheet P, when transferred, is gripped at the same end portion by sheet grippers respectively provided in the impression cylinders 12*a*–12*d* of the back surface printing sections K, K1, the sheet transfer cylinders 26–29, the impression cylinders 11*a*–11*d* of the top surface printing sections L, L1, and so on, the perfecting press of this embodiment presents good printing conditions such as registering accuracy.

While the foregoing tenth to fifteenth embodiments have been described with the impression cylinders 11*a*–11*d* and 12*a*–12*d*, the intermediate cylinders 19, and so on having a diameter double the diameter of the plate cylinders, a cylinder having a diameter three times or more the diameter of the plate cylinder may be used as a common impression cylinder. In this case, a perfecting two-color sheet rotary offset press may be constituted of two sets of top surface printing units including two sets of blanket cylinders, plate cylinders, inking mechanisms, and so on disposed above the common impression cylinder; two sets of back surface printing units including two sets of blanket cylinders, plate cylinders, inking mechanisms, and so on disposed below the common impression cylinder; and an even number of sheet transfer cylinders interconnecting the top surface printing units and the back surface printing units.

In another embodiment, the two sets of top and back surface printing units are defined as a unit, and a plurality of such units are connected through intermediate cylinders to form a top surface printing section, a back surface printing section is formed in a similar structure, and the top surface printing section and the back surface printing section are connected through a plurality of sheet transfer cylinder, thus constituting a perfecting multi-color sheet rotary offset press.

As described above in detail, according to the perfecting sheet rotary offset press of the present invention, top surface printing units and back surface printing units are connected through impression cylinders constituting the respective printing units, so that sheets are transferred by the impression cylinders of the top and back surface printing units. Since printing can be performed on both top and back surface of a sheet, the sheet can be prevented from being curled. Also, the above structure advantageously solves inconvenience inherent to conventional reversal perfecting press, blanket-to-blanket perfecting web rotary press, and other types of perfecting presses.

Further, since a plurality of the top surface printing units and back surface printing units are horizontally connected to each other through impression cylinders constituting the respective printing units, the height dimension of the press can be significantly reduced. This structure is particularly effective when a press for printing large sizes of sheets is designed.

A unit of top and back surface printing units are formed by a top surface printing unit and a back surface printing unit connected in the horizontal direction through impression cylinders having the same diameter as plate cylinders constituting these units. A plurality of the top and back surface printing units are horizontally connected through two intermediate cylinders each having a sheet gripper. With this structure, the height of the press can be reduced as compared with conventional presses, if the printing size is assumed to be identical. It is also possible to provide spaces for maintenance and other works between adjacent top surface printing units and between adjacent back surface printing units.

Since the top and back surface printing units are connected through the impression cylinders such that a line connecting the axes of the impression cylinders extends substantially in the horizontal direction, a sheet is gripped at the same end portion when transferred, so that printing conditions are improved, and inconvenience inherent to conventional presses, such as low printing speed, large size of the press itself, and so on can be solved.

Since a top surface printing section having a plurality of juxtaposed top surface printing units and a back surface printing section having a plurality of juxtaposed back surface printing units are connected through an even number of sheet transfer cylinders, a sheet is gripped at the same end portion when transferred, printing conditions can be improved, and inconvenience inherent to conventional presses, such as low printing speed, large size of the press itself, and so on can be solved. Also, the arrangement of the sheet transfer cylinders allows the height of the press to be further reduced.

What is claimed is:

1. A perfecting sheet rotary offset press comprising:

a plurality of top surface printing units, each of said top surface printing units including an impression cylinder having a sheet gripper, a blanket cylinder a plate cylinder and an inking mechanism, said blanket cylinder, said plate cylinder and said inking mechanism being disposed above said impression cylinder; and a plurality of back surface printing units, each of said back surface printing units including an impression cylinder having a sheet gripper, a blanket cylinder, a plate cylinder, and an inking mechanism, said blanket cylinder, said plate cylinder and said inking mechanism being disposed below said impression cylinder, said top surface printing units and said back surface printing units being alternately arranged in adjacent pairs with their respective impression cylinders in contact with each other such that a line connecting the axes of each impression cylinder extends horizontally to transfer the sheet from the top surface printing unit to the back surface printing unit in the horizontal direction.

2. The perfecting sheet rotary offset press according to claim 1, wherein the respective impression cylinders of each pair are of the same diameter as the associated plate cylinders.

3. The perfecting sheet rotary offset press according to claim 1, wherein the respective impression cylinders have a diameter double that of the associated plate cylinders.

4. The perfecting sheet rotary offset press according to claim 1, wherein the top surface printing unit and the back surface printing unit in each pair are alternately arranged such that the top surface printing unit is located upstream of the back surface printing unit in the printing direction.

5. The perfecting sheet rotary offset press according to claim 1, wherein the top surface printing unit and the back surface printing unit in each pair are alternately arranged such that the top surface printing unit is located downstream of the back surface printing unit in the printing direction.

* * * * *